United States Patent [19]

Dose et al.

[11] 4,441,342

[45] Apr. 10, 1984

[54] TANNING APPARATUS

[76] Inventors: Ludwig Dose, Vogesenstr. 8; Werner Dose, Greffernerstr. 16, both of D-7585 Lichtenau, Fed. Rep. of Germany

[21] Appl. No.: 283,678

[22] Filed: Jul. 15, 1981

[30] Foreign Application Priority Data

Aug. 7, 1980 [DE] Fed. Rep. of Germany ..... 3029856

[51] Int. Cl.[3] ..... D06B 5/24; D06B 23/14

[52] U.S. Cl. ..... 69/30; 68/58; 68/144

[58] Field of Search ..... 68/58, 140, 144, 146, 68/148; 69/30

[56] References Cited

U.S. PATENT DOCUMENTS

| | | | |
|---|---|---|---|
| 2,349,901 | 5/1944 | Breckinridge | 68/140 |
| 2,397,268 | 3/1946 | Jorgenson et al. | 68/144 X |
| 3,466,904 | 9/1969 | Huni | 68/144 X |
| 3,997,292 | 12/1976 | Lutes et al. | 68/58 X |
| 4,122,692 | 10/1978 | Dose | 69/30 |

FOREIGN PATENT DOCUMENTS

| | | | |
|---|---|---|---|
| 5756 | of 1906 | United Kingdom | 68/146 |

*Primary Examiner*—Philip R. Coe
*Attorney, Agent, or Firm*—Michael J. Striker

[57] ABSTRACT

An apparatus for tanning or dyeing includes a horizontal rotary drum which is rotatably mounted in a frame at only one axle front end thereof. The rotary drum defines a treatment chamber for tanning and dyeing which communicates with a hollow axle for admission and drainage of a liquid treatment medium. Within the interior of the rotary drum, at least two ring pocket sections are provided which are in communication with two connecting lines arranged at the axial front end of the rotary drum and extending in radial direction. With their radially external ends, each connecting line opens into the interior of the associated ring pocket section. The other end of each connecting line extends to the center of the rotary drum which center communicates with associated axial channels within the hollow axle. Regardless of the direction of rotation of the drum, the liquid treatment media flows into a respective one of the connecting lines, then through the associated axial channel located within the hollow axle into a tank. From the tank, the medium is turned back into the treatment chamber through one of the axial channels.

27 Claims, 7 Drawing Figures

Fig.4
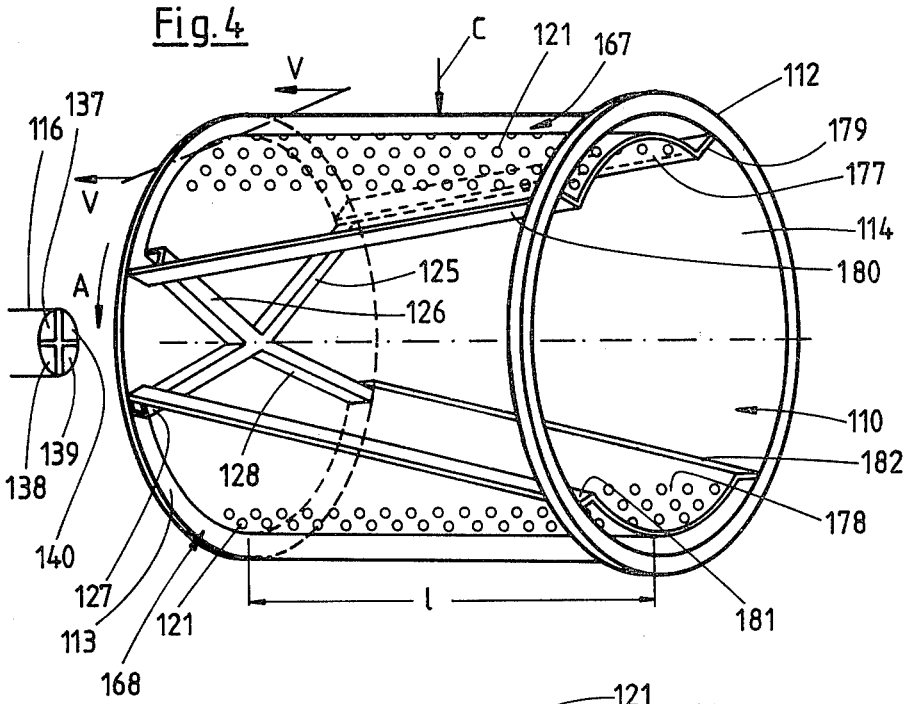
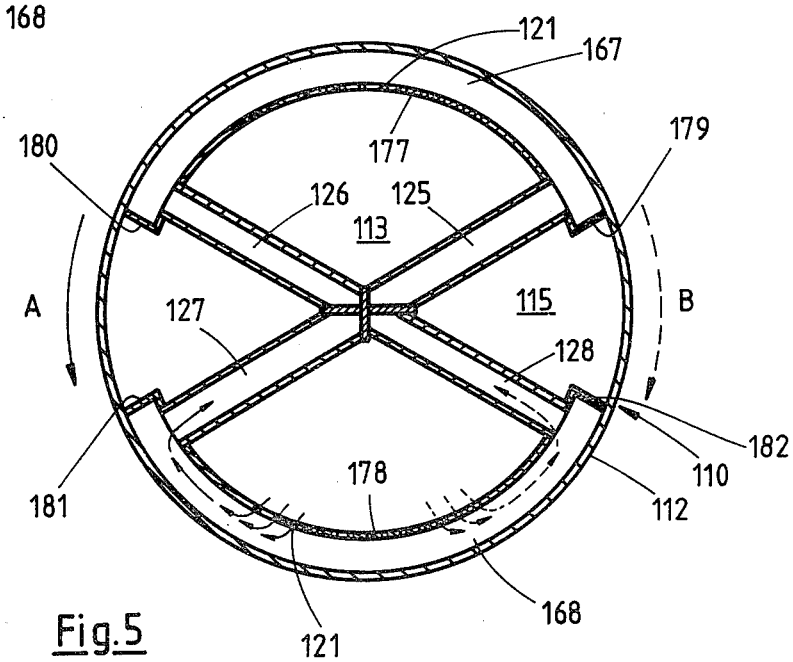
Fig.5

TANNING APPARATUS

BACKGROUND TO THE INVENTION

The invention relates to an apparatus for tanning, dyeing or the like comprising a horizontal rotary drum with an included treatment chamber and comprising a hollow axle, which is in communication with the treatment chamber, for carrying the drum and for the admission and drainage of liquid treatment media, there being provided in the zone of the drum at least two ring-pocket sections which extend in the circumferential direction and each of which is in communication via ports with the treatment chamber, on the one hand, and is connected to two front end and approximately radial connecting lines which open out with one end into the interior of the associated ring pocket sections and with the other end, which is in the region of the drum center, into respectively associated axial channels in the interior of the hollow axle, to which there is connected an enclosing tank which is sealed by means of a face seal.

STATEMENT OF PRIOR ART

The specification of the published German Pat. No. 26 48 057 discloses apparatus in which the interior of a rotary drum is subdivided into several treatment chambers, there being provided for each treatment chamber special feed holes which are closable by means of covers. The treatment chambers are formed in that axially fully continuous perforated radial partition walls are provided in the interior of the drum jacket. Moreover, the device has three axially fully continuous ring-pocket sections. Associated with each of these ring-pocket sections are two connecting ducts of the described kind, of which one connecting duct extends at one axial front end of the rotary drum and the other connecting duct extends at the other front end thereof. The rotary drum has in its centre an axially fully continuous hollow axle, which is subdivided into three axial channels. The connecting ducts extending at one front end of the rotary drum open out into respectively associated axial channels. At the opposite front end of the rotary drum, the connecting ducts provided there open out, with their ends which are located in the centre, through an opening in the front cover into a flanged pipe socket which is larger in diameter and which encircles the hollow axle, which is brought out and continued at this rotary drum end, coaxially and with a radial clearance. This larger flanged pipe socket is also subdivided into three axial ring channels, each of which is associated with a connecting duct at this axial front end.

This device has had considerable proven success. However, the subdivision of the treatment chamber by the radial partition walls and, above all, the hollow axle which is axially taken through the treatment chamber over its entire length as well as the connecting ducts at both front ends have a disturbing effect inasmuch as this reduces the loading capacity of the interior of the drum. Above all when relatively thick material is to be treated, more especially thick leathers, these special features become noticeable in a disadvantageous manner. The leather is agitated insufficiently so that the mechanical action exerted on the material that is treated is then inadequate. The chemicals, which form part of the liquor, are sometimes irregularly, in any event inadequately, incorporated into the material that is treated, particularly thick leathers.

OBJECT OF THE INVENTION

An object of the invention is to provide a device for tanning, dyeing or the like which, while maintaining the special skimming-off principle, renders possible a considerably improved space utilisation of the drum interior and which, as regards its construction, including all the individual components, can be of an even simpler, lighter and cheaper design and which, above all when thick leathers are treated, renders possible an increased agitation and incorporation of the chemicals into the material to be treated, thus bringing about, also in connection with such a material, a better result of the treatment.

SUMMARY OF THE INVENTION

According to the invention we provide an apparatus for tanning, dyeing and like treatment, comprising a horizontal rotary drum, a treatment chamber therein, a hollow axle, which is in communication with the treatment chamber, for carrying the drum and for the admission and drainage of liquid treatment media, at least two ring-pocket sections provided in the zone of the drum which extend in the circumferential direction and each of which is in communication via ports with the treatment chamber, and connecting lines of the individual ring-pocket sections provided at the axial front end of the rotary drum, said lines being in the form of substantially radial connecting lines all of which open out with one end into the interior of associated ring-pocket sections and with the other end, which is in the region of the drum center, into respectively associated axial channels in the interior of the hollow axle, wherein the interior of the treatment chamber and the other axial front end of the rotary drum are free of connecting lines. In this connection, the term 'connecting lines' denotes lines in a general fluidic sense.

The configuration according to the invention leads to a drum interior which is completely free in the axial and radial directions, so that this entire space can be utilised for the material to be treated. In this way, it is possible, during the rotation of the rotary drum, that the material is taken along to the top and, from the top, then has available as the height of drop virtually the entire drum diameter, over which the material to be treated can drop. This results, surprisingly, in a considerably increased mechanical agitation and in a thorough agitation of the material treated, more especially leather. The mechanical treatment is thus considerably increased. This also enhances the chemical treatment. The chemicals contained in the liquid treatment medium are caused to be incorporated into the material to be treated, more especially leather, considerably more thoroughly. Moreover, the considerably reduced expenditure is advantageous since over the axial drum length the otherwise provided hollow axle, including its internal channels, is completely dispensed with. The expenditure is also substantially reduced by the non-existing radial partition walls. All in all, there comes about a device which is lighter and, above all, cheaper because of the lower expenditure of material and which, while maintaining the special skimming system, brings about a considerably improved treatment of the material loaded thereinto.

In addition, it is advantageous if, in an advantageous constructional form, the drum jacket is provided with drivers which project towards the interior of the treatment chamber, more especially blades, strips or pins which alternate in the circumferential direction, or other mechanical drivers. These are capable of taking the material, which is moved in the treatment chamber, to the top during the rotation of the rotary drum so as to ensure the subsequent dropping thereof over almost the entire drum diameter. At the same time, these drivers contribute to increasing the mechanical agitation of the material and thus to improving the result of the treatment.

A further configuration of the ring-pocket sections, which are also called skimming pockets, causes the interior space of the rotary drum to be only slightly reduced, and this only in an axial front zone, where all the connecting ducts are provided.

Another advantageous configuration ensures that, with the drum rotating in both directions of rotation, the skimming-off occurs in the zone of one front end, and this through one connecting line of a ring-pocket section in one direction of rotation and through the other connecting line thereof in the opposite direction of rotation.

The combination of the individual connecting lines in channel form as double channels leads to a further saving in material and weight and thus to a reduced expenditure and reduced costs. At the same time, this configuration has a stiffening effect on the entire system.

Three and more cylindrical jacket chambers may be provided at equal circumferential-angle intervals. Since these cylindrical jacket chambers extend over the entire axial length of the rotary drum, this results in a particularly good liquor circulation since, due to the inclined extension of the respective inclined edges, the liquor is also skimmed from that front end which is opposite to the other front end carrying the connecting lines. Above all, cylindrical jacket chambers designed in such a way have the advantage that they can be produced in a particularly simple and cheap manner. Only a very small amount of waste has to be taken into account during the cutting of the appropriate metal-sheet parts. The trapezium shape saves material, on the one hand, and leads eo ipso to the inclined extension of the inclined edges with respect to an axially parallel generating line, on the other hand. It is furthermore advantageous that, over their zone, the cylindrical jacket chambers contribute to the stiffening of the external drum jacket so that, depending on its total size, this jacket can be made thinner and lighter.

Depending on its diameter and length, the rotary drum may be supported and mounted in the zone of both axial front ends.

Unilateral mounting with an integrated drive of the rotary drum leads to a special simplification and thus to a reduction of the costs. At the same time, this ensures that the axial distance of the bearing point and the driving point from the centre of gravity can be kept as short as possible, causing the lever arm for acting moments, and thus the latter, to be as small as possible. Furthermore, the drive and the bearing lie in a common plane so that there do not act from the drive any additional bending forces with a lever arm in the zone of the bearing. Despite the simple mounting and the drive of relatively simple design provided there, there is furthermore effected in the zone of the bearing point the removal and admission of the liquor with the interposition of the enclosing tank or vessel with free access to the liquor.

Further details and advantages will emerge from the following description.

BRIEF DESCRIPTION OF THE DRAWINGS

The invention will hereinafter be explained in more detail with reference to some exemplified embodiments shown in the drawings, in which:

FIG. 4 shows a diagrammatical perspective view of only the rotary drum of a device according to a second exemplified embodiment, FIG. 5 shows a section along the line V—V in FIG. 4.

DESCRIPTION OF THE PREFERRED EMBODIMENT

Figure 1A:
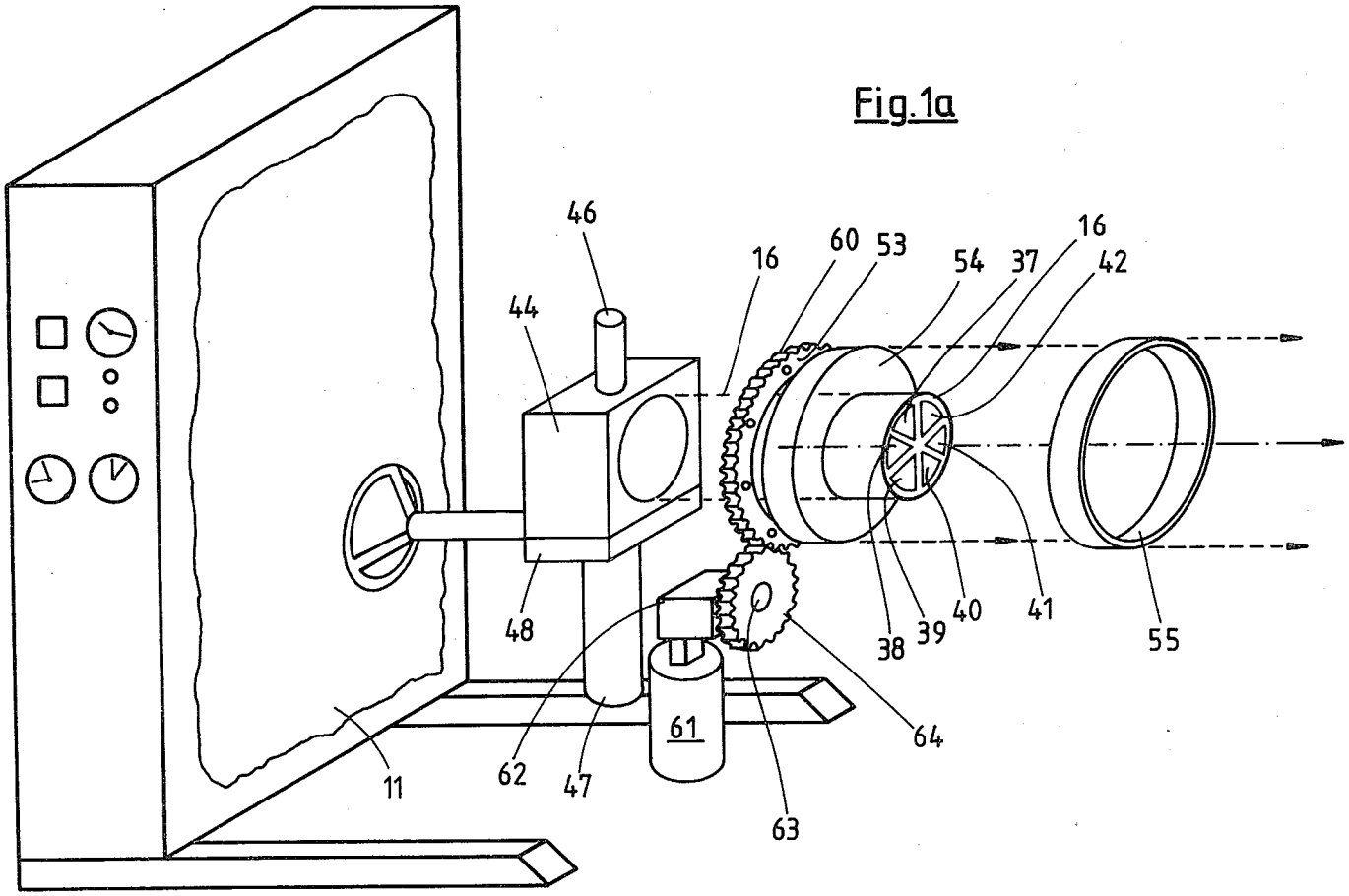
FIG. 1*a* shows diagrammatic perspective view of the apparatus according to a first exemplified embodiment, only the most important parts and the device being shown in an exploded view for the sake of clarity.
Figure 1B:
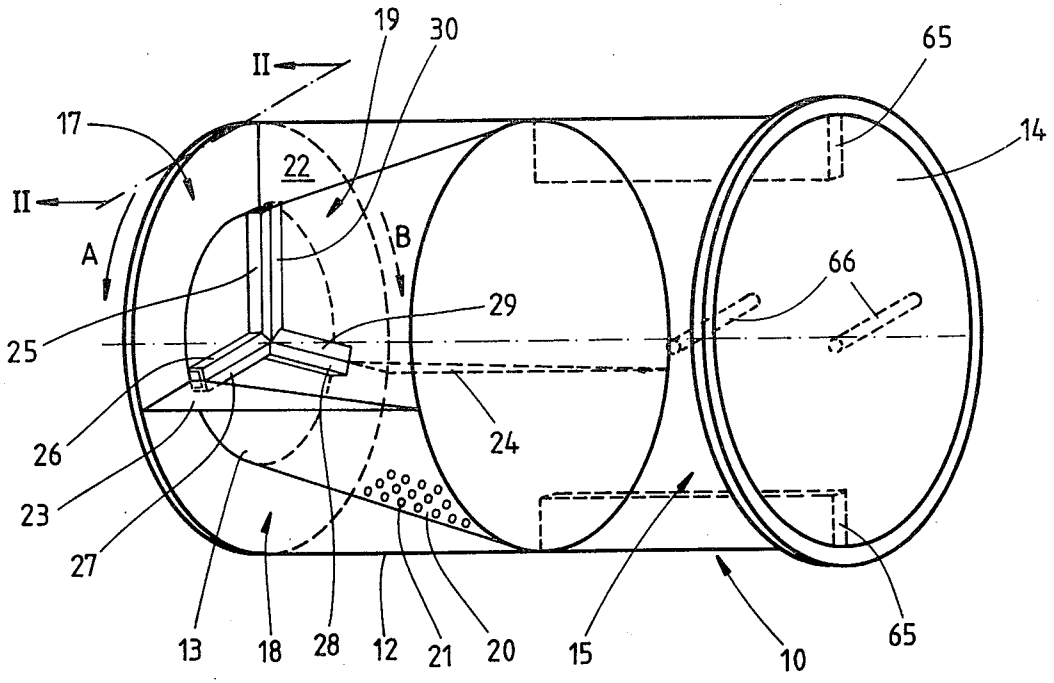
FIG. 1*b* shows an enlarged perspective view of the drum.
Figure 2:
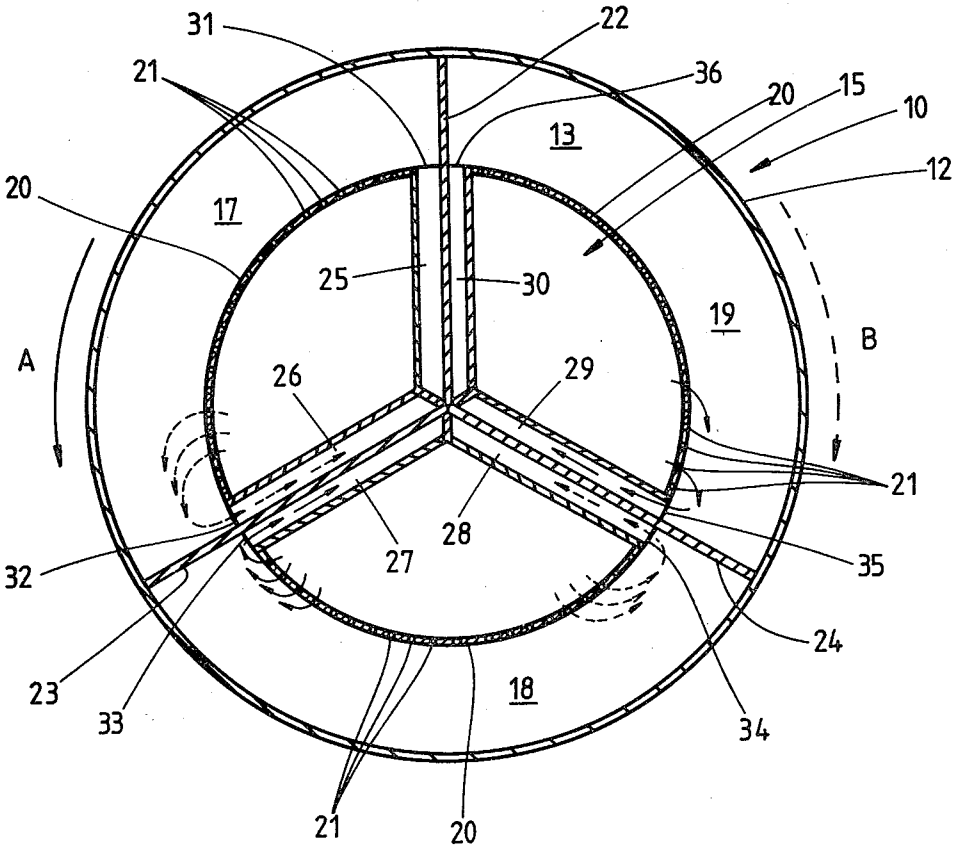
FIG. 2 shows a diagrammatical section along the line II—II in FIG. 1.
Figure 3:
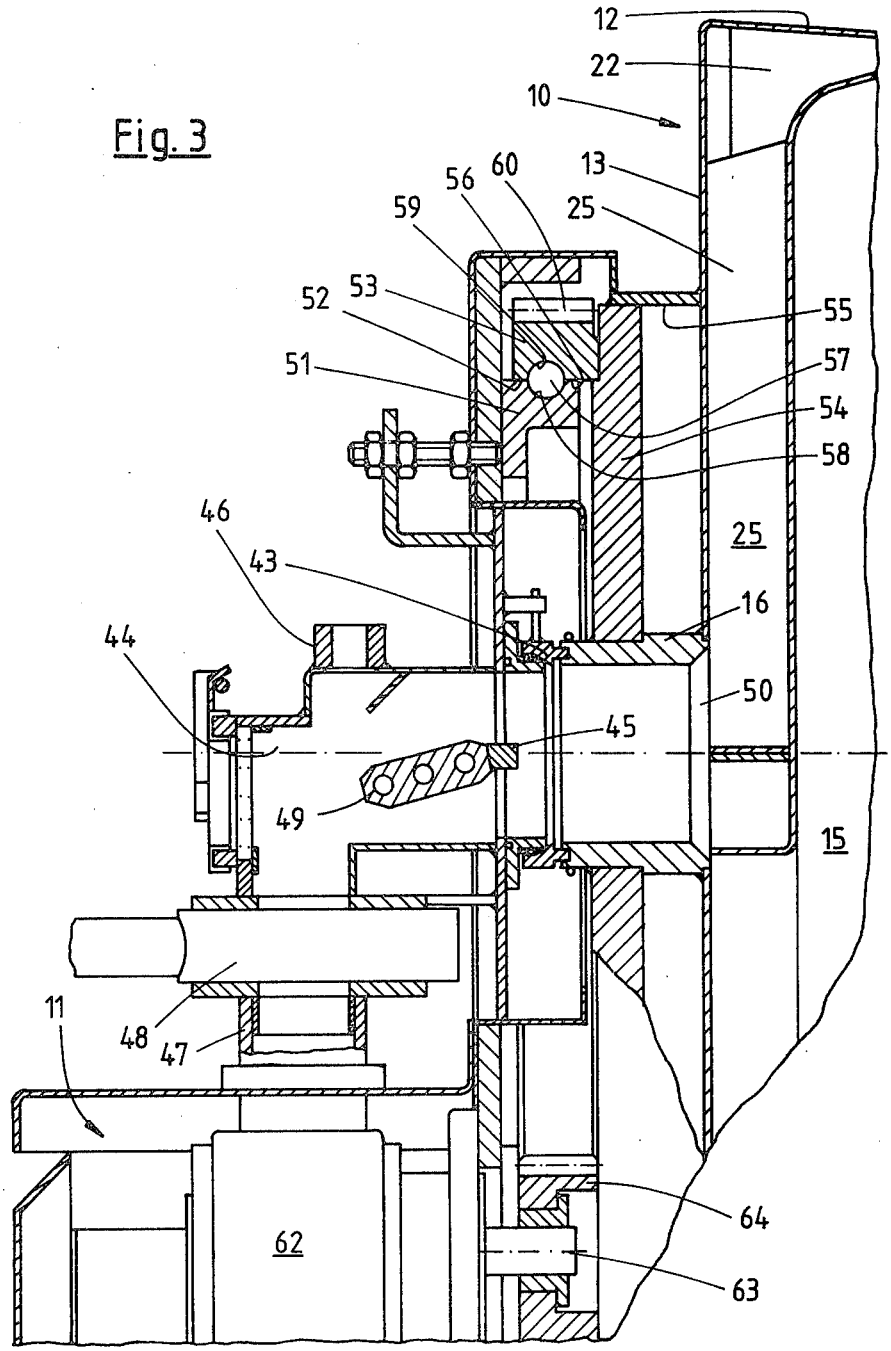
FIG. 3 shows an axial longitudinal section of a part of the device shown in FIG. 1, in the assembled state.

The device according to the first exemplified embodiment shown in FIGS. 1 to 3 has a horizontal rotary drum 10 which is rotatably mounted in a frame 11 only at the axial front end that is to the left in FIG. 1 and which is driven by means of a drive yet to be described, for example fully rotating for 5 minutes in the direction of rotation indicated by the arrow A and thereafter in the opposite direction of rotation indicated by the arrow B. The rotary drum 10 has on its outside a metallic seam-welded cylindrical drum jacket 12 which, at the front end that is to the left in FIG. 1, is tightly sealed by means of a welded-on front cover 13 and, at the front end that is to the right in FIG. 1, carries a cover 14, which is detachably secured thereto and consists, for example, of transparent plastics material, and is also tightly sealed there. In the interior of the drum jacket 12, there is formed a single large-space treatment chamber 15 for tanning, dyeing and treating in other ways the introduced material. The treatment chamber 15 is accessible for loading and unloading via a feed hole, which is not specially shown, in the drum jacket 12. The feed hole can be shut off by means of a removable cover or sliding cover, which is also not shown.

The rotary drum 10 is furthermore provided with a hollow axle 16 which serves for carrying the rotary drum 10, on the one hand, and for the admission and/or drainage of liquid treatment media, on the other hand. The hollow axle 16 is only indirectly in communication with the treatment chamber 15.

In the zone of the drum jacket 10, there are provided at least two, in the exemplified embodiment shown altogether three, ring-pocket sections 17, 18 and 19 which extend in the circumferential direction and directly adjoin one another. The ring-pocket sections 17 to 19 are formed by an approximately frusto-conical internal jacket 20 which is provided with perforated holes 21 in its wall. With its end portion that is smaller in diameter, the internal jacket 20 is secured, more especially welded, to the front cover 13 on the left-hand side in FIG. 1, while the other end of the internal jacket 20, which is larger in diameter, bears against the inside of the drum jacket 12 and is also secured, for example welded, thereto. In this way, there comes about between the drum jacket 12 and the internal jacket 20 an enclosed ring space which is subdivided by means of radial separating members 22, 23 and 24, which are impermeable, thus forming the ring-pocket sections 17, 18 and 19. Each of the ring-pocket sections 17 to 19 is therefore in communication with the treatment chamber 15 via the perforated holes 21. The ring-pocket sections 17 to 19 are separated from one another by the separating members 22 to 24. The three radial separating members 22 to 24 are provided at equal circumferential-angle intervals and are fixedly welded in. The angle of cone of the frusto-conical internal jacket 20 can be relatively small, and so can the axial length of the internal jacket 20, so that there is available a treatment chamber 15 that is as large as possible.

Associated with the ring-pocket sections 17, 18 and 19 are two connecting ducts on lines 25, 26 and 27, 28 and 29, 30 respectively. All of these connecting lines 25 to 30 sit at the front end of the rotary drum 10 that is to the left in FIG. 1, so that the treatment chamber 15 is not occupied and made smaller by the connecting lines 25 to 30. On the contrary, the entire interior space of the treatment chamber 15 is available in the circumferential and axial directions for the loading and thorough milling of the material to be treated.

The connecting lines 25 to 30 extend substantially radially. With their radially external ends 31 to 36 (FIG. 2), they open out into the interior of the associated ring-pocket sections 17, 18 and 19 respectively. With their other ends, which are located in the zone of the centre of the rotary drum 10, the individual connecting lines 25 to 30 open out separately into respectively associated axial channels 37 to 42 in the interior of the hollow axle 16. Connected to the hollow axle 16 is, via a face seal 43, a stationary sealed enclosed tank 44 which may be subdivided in its interior by a horizontal separating plate 45 into an upper half and a lower half. In the zone of the enclosed tank 44, there is possible the addition of liquid or powdery chemicals to the treatment medium, steam heating through heat of condensation by means of a steam injector, the measurement of the pH-value or the temperature, or the like. In the zone of the enclosed tank 44, there thus exists free and easy access to the liquor. An inflow channel 46 opens into the enclosed tank 44. Furthermore a drain channel 47 branches therefrom, which is controlled by means of a slide valve 48. In FIG. 3, a heating device 49 is furthermore diagrammatically indicated in the interior of the enclosed tank 44.

As emerges from FIGS. 1 to 3, all six connecting lines 25 to 30 of the three ring-pocket sections 17 to 19 are provided at one axial front end of the rotary drum 10, which is to the left in FIGS. 1 and 3. The interior of the treatment chamber 15 and the other axial front end of the rotary drum 10, which is to the right in FIG. 1, is free of any connecting lines. All six connecting lines 25 to 30 open out into their respective axial channels 37 to 42 in the hollow shaft 16 at the axial front end that is to the left in FIG. 1.

Each of the ring-pocket sections 17 to 19 has one connecting line 25, 27 or 29 provided in the circumferential direction of the rotary drum 10 at one circumferential end of the associated ring-pocket sections 17, 18 and 19 respectively and the other connecting line 26, 28 or 29 in the circumferential direction at the other circumferential end thereof. Where the ring-pocket sections 17, 18 and 19 are adjacent to one another in the circumferential direction, the connecting lines provided there directly bear against one another. They have been combined there to form a double channel, there being still maintained the separation between the individual connecting lines. By this means, there come about the double channels 25, 30 and 26, 27 and 28, 29 respectively, which are separated by a respective central wall. The separating central walls run approximately as radial extensions of the separating members 22, 23 and 24 respectively. One sees that, with their ends 31 to 36, the individual connecting lines 25 to 30 end substantially at the level of the internal jacket 20, in other words they do not project into the interior of the ring-pocket sections 17, 18 and 19 respectively.

The individual connecting lines 25 to 30 are formed by channels which are approximately quadrangular in cross section and which are welded in at the axial front end that is to the left in FIG. 1. These channels are formed by trough profiles which are approximately U-shaped in cross section and which, while closing the trough opening on the inside, closely bear against the front cover 13 of the rotary drum 10 and are welded thereto.

The front cover 13 has in the centre a port 50 through which the respective end of the individual connecting lines 25 to 30 that is in the centre is taken separately into the associated axial channels 37 to 42 in the hollow axle 16. The hollow axle 16 is welded to the front cover 13.

For the unilateral mounting of the rotary drum 10 at the end that is to the left in FIG. 3, there is fixedly connected to the frame 11 a supporting ring 51 which is coaxial with the drum axis and which carries a bearing surface 52 on its external circumferential surface. Coaxially therewith, there is provided at the drum end, a bearing ring 53 which is detachably secured to a front disc 54. The front disc 54 is centered on the hollow axle 16 and is secured thereon by welding. On the outside, the front disc 54 is embraced by a ring 55 which is welded to the front disc 54, on the one hand, and to the front cover 13, on the other hand. The bearing ring 53 at the drum end is in this way fixedly connected to the front cover 13 and the rotary drum 10. The bearing ring 53 has on its internal circumferential surface a bearing surface 56 which is associated with the bearing surface 52 of the supporting ring 51 and cooperates with this surface. The bearing ring 53 engages with its bearing surface 56 over the supporting ring 51. Between the supporting ring 51 and the bearing ring 53, there have been inserted for mounting rolling elements, more especially a ball-type turntable which is fitted therebetween and of which only one ball 57 is discernible in FIG. 3. In adaptation thereto, the bearing surfaces 52 and 56 are provided with approximately semi-circular ring grooves 58 and 59 respectively, in which the balls 57 run.

On its external circumferential surface, the bearing ring 53 at the drum end is provided with a circumferential toothing 60 so that the bering ring 53 is a toothed gear, on the one hand, and a bearing part, on the other hand. The circumferential toothing 60 serves for driving the rotary drum 10. For this purpose, there is provided in the frame 11 a drive motor 61 with a reduction bearing 62 which is designed as a bevel gearing and carries on the driven shaft 63 a driving pinion 64 which meshes with the circumferential toothing 60.

Hereinafter, the mode of operation of the device will be described, a start being made from a rotation in the direction of the arrow A in the representation shown in FIG. 1. Furthermore, it is assumed that the treatment chamber 15 has been loaded with the material to be treated and that the liquor circulates within the rotary drum 10, in other words that a shut-off slide valve, which controls a throttle port in the enclosing tank 44, has been opened and the throttle port for the return flow to the rotary drum 10 has been uncovered.

Due to the internal jacket 20 being provided with perforated holes 21, the liquor can flow from the treatment chamber 15 radially into each of the ring-pocket sections 17, 18 and 19. When the rotary drum 10 is, for example, approximately in the rotational position shown in FIG. 2, the liquor flows, when considering the ring-pocket section 19, from the interior of the treatment chamber 15 through the perforated holes 21 in the direction of the indicated arrows radially downwards into the ring-pocket section 19. In so doing, the liquor impinges on the separating member 24, thus forcing the liquor to penetrate through the open end 35 in the direction of the indicated arrows into the connecting line 29. In this zone, the liquor is thus skimmed off from the ring-pocket section 19 by means of the connecting line 29. Following an axial deflection, the medium passes through the connecting line 29 into the axial channel 41, which is associated with this connecting line 29, in the hollow axle 16 and therethrough into the enclosing tank 44. After a deflection has taken place therein, there follows the return flow through any one of the axial channels 37 to 42 and one of the associated connecting lines 25 to 30 connected thereto and from there the introduction into the associated ring-pocket section 17, 18 or 19 and from this section through the perforated holes 21 into the treatment chamber 15.

As the rotary drum 10 continues to rotate in the direction of the arrow A, the connecting line 27 will then be approximately in the position which the connecting line 29 has in the representation of FIG. 2. The liquor then passes in the direction of the arrows from the treatment chamber 15 through the perforated holes 21 into the ring-pocket section 18. Inside the ring-pocket section 18, the liquor flows against the separating member 23 and is therefore forced to flow through the open external end 33 of the connecting line 27 into the latter. Consequently, a proportion of the liquor is then skimmed off from the ring-pocket section 18 through the connecting line 27. The skimmed liquor passes from the connecting line 27 into the axial channel 39 in the hollow axle 16. Thereafter, it takes the same path that has been described before.

As the rotary drum 10 continues to rotate in the direction of the arrow A, the connecting line 25 finally reaches approximately the rotational position which the connecting line 29 has in FIG. 2. Then a skimming-off of the liquor from the ring-pocket section 17 is effected through the open end 31 of the connecting line 25. The skimmed liquor passes from the connecting line 25 through the axial channel 37 into the enclosing tank 44 and then back into the treatment chamber 15 in the described manner.

On the respective return path, there occurs a thorough mixing of the liquor with the proportion thereof which is in the ring-pocket sections 17 to 19, and this before the liquor passes again into the treatment chamber 15. In other words, the mixing effect is particularly good as a result.

When the direction of rotation is reversed and the rotary drum 10 is driven in the opposite direction, as indicated by the arrow B, skimming-off is effected as follows. When the rotary drum 10 has reached the position approximately shown in FIG. 2, the liquor passes—as shown in broken-line arrows—from the treatment chamber 15 through the perforated holes 21 in the internal jacket 20 into the ring-pocket section 18. Due to the rotation in the direction of the arrow B, the liquor impinges on the separating member 24 and is forced to flow through the open end 34 into the connecting line 28, through which the skimming from the ring-pocket section 18 is thus effected. After having been axially deflected, the liquor passes through the associated axial channel 40 in the hollow axle 16 and then returns in the described manner into any one of the ring-pocket sections 17, 18 or 19.

In a corresponding manner, there is effected, during the rotation of the drum in the direction of the arrow B, a skimming-off of the liquor in the ring-pocket section 19 through the connecting line 30 and then in the ring-pocket section 17 through the connecting line 26, as is indicated in broken-line arrows in FIG. 2.

Consequently, there is effected a skimming-off of the liquor in both directions of rotation of the rotary drum 10 in the direction of the arrow A and in the opposite sense thereto in the direction of the arrow B. The flow of the liquor occurs in each case at an extremely high flow velocity.

If the rotary drum 10 is to be drained, then the throttle port in the enclosing tank 44, also called vessel, is shut by means of a slide valve and an appropriate drain port in the drain channel 47 is opened. The liquor can now be freely drained, while the rotary drum 10 rotates in one direction of rotation or the other.

In another exemplified embodiment, which is not shown, the rotary drum 10 is rotatably mounted on both axial front ends by means of hollow axles rather than only at the end that is to the left in FIG. 1, as described, while the configuration thereof is otherwise the same.

Figure 6:
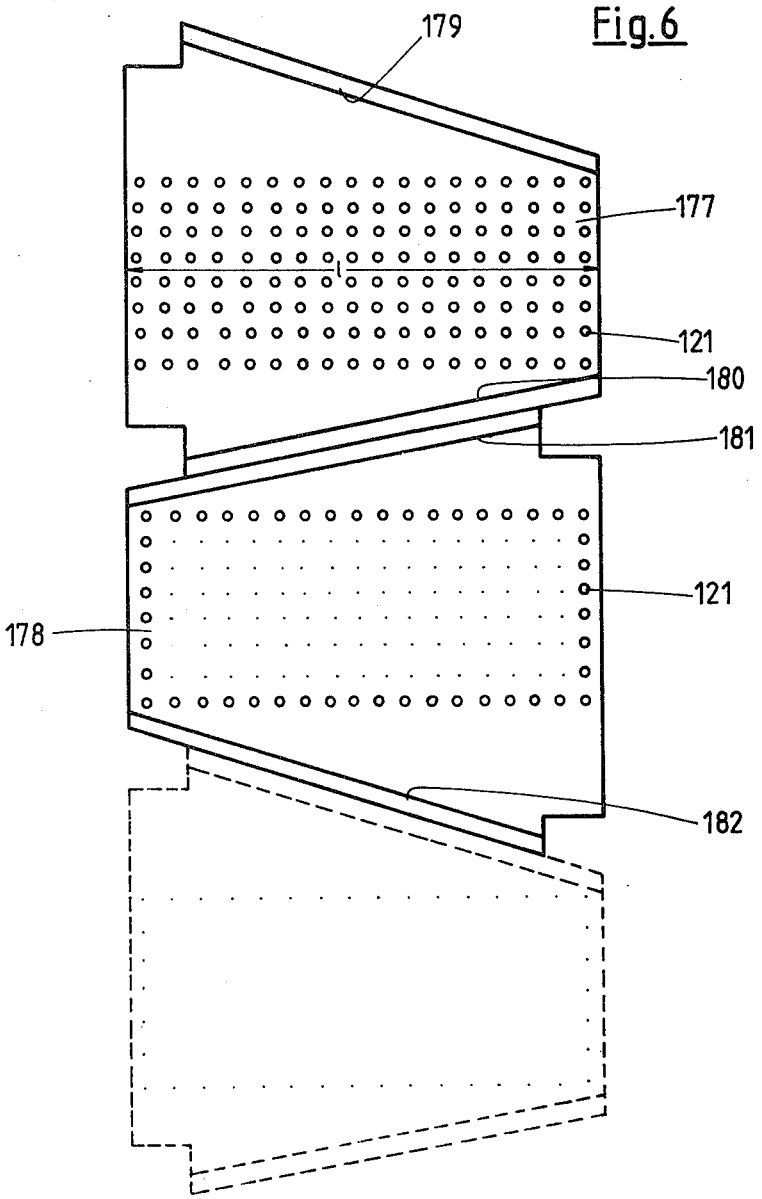
FIG. 6 shows a top view of a metal-sheet blank for the formation of the cylindrical jacket parts of the cylindrical jacket chambers of the device according to the second exemplified embodiment.

In the second exemplified embodiment shown in FIGS. 4 to 6, the reference symbols of the parts which correspond to those used in the first exemplified embodiment have been increased by 100, so that, in order to avoid any repetition, reference is thus made to the description of the first exemplified embodiment.

The second exemplified embodiment differs from the first one with respect to the configuration of the ring-pocket sections. Inside the drum jacket 112, there are provided in the manner shown two—in a modified constructional form however just as well three—cylindrical jacket chambers 167, 168 as the ring-pocket sections. The two cylindrical jacket chambers 167, 168 are arranged at equal circumferential-angle intervals. In the exemplified embodiment shown, they extend axially over the entire length 1 of the rotary drum 110. Considered in a top view, for example in the direction of the arrow C in FIG. 4, each of the cylindrical jacket chambers 167, 168 has substantially the shape of a trapezium, the larger trapezium side pointing to the front cover 113 that is to the left in FIG. 4 and to the end at which all the connecting lines are provided. Since only two ring-pocket sections in the shape of the cylindrical jacket chambers 167, 168 are provided, there are altogether only four connecting lines; 125, 126, on the one hand, and 127, 128, on the other hand. The two connecting lines 125, 126 open out into the cylindrical jacket chamber 167, while the other connecting lines 127, 128 open out into the other cylindrical jacket chamber 168. The narrower trapezium side of each cylindrical jacket chamber 167, 168 ends approximately in the zone of the other front end cover 114.

The cylindrical jacket chambers 167, 168 are formed by special internal jacket segments 177 and 178 respectively. These internal jacket segments 177, 178 can be seen in the state in which they are not yet bent in the development in FIG. 6. In a top view, they have the shape of a trapezium which is, more especially, symmetrical and has inclined edges 179, 180 and 181, 182 respectively which diverge from the smaller trapezium side towards the larger one. The internal jacket segments 177, 178 have been bent into an internal cylindrical jacket part which extends substantially parallel to the drum jacket 112 and at a radial distance therefrom, so that the cylindrical jacket chambers 167 and 168 come about. The inclined edges 179, 180 and 181, 182 respectively of the internal jacket segments 177 and 178 are chamfered along the lines shown in FIG. 6 so that separating members thus come about. The separating members thus formed are secured, more especially welded, with their free edge, to the inside of the drum jacket 112.

Due to the trapezium shape, the chamfered inclined edges 179, 180 of the internal jacket segments 177 and 181, 182 of the other internal jacket segment 178 extend— with respect to an axially parallel generating line of the drum jacket 112—from the end that is to the left in FIG. 4 towards the other end obliquely at an angle to an axially parallel generating line.

In the case of both cylindrical jacket chambers 167, 168 the larger trapezium end is at the front end of the rotary drum 110 that is to the left in FIG. 4. Likewise, the respectively associated connecting lines 125 to 128 are located there. If one considers only one cylindrical chamber, 167, then the connecting line 125 opens out into this cylindrical jacket chamber at one circumferential end and the connecting line 126 opens out thereinto at the other circumferential end. The conditions are the same with respect to the other cylindrical jacket chamber 168. The internal jacket segments 177, 178 are obtained during the production from a substantially strip-shaped metal-sheet blank (FIG. 6), namely from pieces which are directly consecutive in the strip direction and which are arranged in opposite senses with respect to the trapezium position so that there is virtually no waste during the production by stamping. Prior to bending and installing, the internal jacket segment 178 is then rotated through 180° so that the larger trapezium side thereof, exactly like that of the other internal jacket segment 177, lies on the left-hand side according to FIG. 6. It is not over their entire surface that the internal jacket segments 177, 178 are provided with perforated holes 121 but only over one cylindrical jacket surface, whose width corresponds, more especially, approximately to that of the shorter trapezium end.

In the rotational position of the rotary drum 110 shown in FIG. 5 and during the rotation thereof in the direction of the arrow A, the liquor passes from the treatment chamber 115 in the direction of the indicated arrows through the perforated holes 121 in the internal jacket segment 178 into the cylindrical jacket chamber 168. Due to the inclination of the inclined edge 181 over the axial length, the liquor is during this process guided from the end that is to the right in FIG. 4 to the skimming-off end in a rapid flow as far as the connecting line 127, through which skimming-off takes place.

Similarly, when the drive occurs in the direction of the arrow A, skimming-off is effected via the other cylindrical jacket chamber 167, namely through the inclined edge 179 into the connecting line 125.

When the drive occurs in the opposite sense in the direction of the arrow B, skimming-off takes place in the zone of the cylindrical jacket chamber 168 through the inclined edge 182 and the connecting line 128. In the zone of the cylindrical jacket chamber 167, skimming-off is effected via the inclined edge 180 thereof and the connecting line 126.

In adaptation to only four existing connecting lines 125 to 128, the hollow axle 116 is also provided with only four associated axial channels 137 to 140 in the second exemplified embodiment.

It is obvious that by modifying the second exemplified embodiment it is possible to provide a third cylindrical jacket chamber which is obtained from the third internal jacket segment which is only indicated in broken lines in FIG. 6. In order to allow, in the zone of the wider trapezium side, the channel-shaped connecting lines 125 to 128 provided there to open out into the cylindrical jacket chamber, there have been taken into consideration in the metal-sheet blank of each of the internal jacket segments 177, 178 at the wider ends thereof the recesses which are apparent from FIG. 6.

If three cylindrical jacket chambers are provided, then these are expediently arranged at equal circumferential-angle intervals. Several ring-pocket sections of the kind as provided in the first or second exemplified embodiments are also within the scope of the invention.

In another exemplified embodiment, which is not shown, the rotary drum 110 shown in FIGS. 4 to 6 is not only rotatably mounted at the end that is to the left in FIG. 4, according to the first exemplified embodiment, but is received in bearings at both axial front ends. As before, both the drive and the enclosing tank may be provided, with access to the liquor, in the left-hand end zone.

In all exemplified embodiments, it is particularly advantageous if, as has been indicated only diagrammatically and in broken lines in FIG. 1, the drum jacket 12 has on its inside drivers which project into the interior of the treatment chamber 15 and which consist, for example, of blades 65 and pins 66 which alternate in the circumferential direction. It is obvious that several pins 66 and also continuous or uninterrupted blades 65, strips or the like drivers may be provided in the axial direction over the drum length. These drivers have the advantage that the material being treated is by this means taken upwardly during the rotation of the rotary drum 10 so that it can then drop from the top through the entire diameter of the rotary drum 10. This results in a substantially increased milling operation and milling action, which simultaneously causes the chemicals contained in the liquor to be incorporated into the material, more especially leather, in an even better manner. This configuration is particularly suitable for the treatment of thick materials, in other words thick leathers or the like. Moreover, the inwardly projecting drivers act on the material being treated in a generally mechanical manner so that by this means the milling operation is basically increased and is improved by milling.

In the afore-described exemplified embodiments, the rotary drums 10 and 110 consist of metal. In another exemplified embodiment not shown, the rotary drum consists however, for example, of wood and/or plastics material and/or metal, for example the external drum jacket together with further single components consisting of wood and the other components consisting of metal and/or plastics material. A wide variety of materials are thus used. The invention is not confined to a configuration in metal. On the contrary, it expressly also covers configurations made either entirely of wood or of wood with a subsequent installation of the described special components, these then being in metal and/or plastics material or also in wood.

We claim:

1. An apparatus for tanning, dyeing and like treatment, comprising:

(a) a horizontal rotary drum having an axial front end and a circumferential surface;

(b) a treatment chamber defined in the rotary drum;

(c) a hollow axle which is in communication with the treatment chamber for carrying the drum and for admission and drainage of liquid treatment media, said hollow axle having an interior defining a plurality of axially extending channels;

(d) at least two ring-pocket sections provided along the circumferential surface of the drum, each of the two ring-pocket sections being in communication with the treatment chamber; and (e) connecting lines communicating with the individual ring-pocket sections and provided only at the axial front end of the rotary drum for admission and drainage of the liquid treatment media so that the interior of the treatment chamber and of the other axial front end of the rotary drum are free of connecting lines, each of said connecting lines extending substantially radially between the drum center of the axial front ends and the associated ring-pocket section and having one end opening into the interior of the associated ring-pocket section and another end arranged in the region of the center opening into the respectively associated axial channels in the interior of the hollow axle, wherein each ring-pocket section communicates with two connecting lines, the one of which being provided in the circumferential direction of the rotary drum at one end of the respective ring-pocket section and the other of which being provided in the circumferential direction at the other end thereof, so that regardless of the rotation of the drum, the liquid treatment media is admitted into one of the two connecting lines of the associated ring-pocket section.

2. Apparatus according to claim 1, and further comprising an approximately frustro-conical internal jacket within said drum at the axial front end at which all the connecting lines are provided, said jacket including a wall provided with a plurality of ports and having one end part of smaller diameter with respect to the other end part the one end part being secured to the axial front end of the rotary drum and the other end being secured to the drum so that a ring space is defined between the jacket and the drum, and substantially radial separating members for subdividing the ring space enclosed between the drum and the internal jacket for forming said ring pocket sections.

3. Apparatus according to claim 2, wherein three substantially radial separating members at each circumferential-angle intervals are provided for defining three separated ring pocket sections which are directly contiguous to one another in the circumferential direction of the drum and located on the line of the drum and located at the axial front end of the rotary drum.

4. Apparatus according to claim 2, wherein the connecting lines, with their ends that open out into the respective ring-pocket sections, end approximately with the internal jacket.

5. Apparatus according to claim 4, wherein the connecting lines are formed by channels which are approximately quadrangular in cross section and which are welded to the axial front end.

6. Apparatus according to claim 5, wherein the channels are formed by trough profiles which are approximately U-shaped in cross section and which tightly bear against the inside of the front cover of the rotary drum thereby sealing the trough opening.

7. Apparatus according to claim 1, wherein respectively two connecting lines bear directly against each other at the ends, which are adjacent in the circumferential direction, of two adjoining ring-pocket sections and are combined as double channels.

8. Apparatus according to claim 1, wherein the axial front end of the drum is formed as a front cover having a center provided with a port, through which the other end of each connecting line, which end is located in the center, leads, separated from the other, into the associated axial channel in the hollow axle.

9. Apparatus according to claim 8, wherein the hollow axle is fixedly attached to the front cover.

10. Apparatus according to claim 1, and further comprising a frame, the rotary drum being mounted in the frame only at the axial front end carrying all the connecting lines.

11. Apparatus according to claim 10, wherein the frame includes a stationary supporting ring, which is coaxial to the rotary drum and further comprising a bearing ring of the rotary drum, which bearing ring is coaxial with the supporting ring and is fixedly connected to the front cover of the rotary drum and which engages over the supporting ring, and rolling elements which are provided between the supporting ring and the bearing ring.

12. Apparatus according to claim 11, and further comprising a front disk centered on and secured to the hollow axle the bearing ring at the drum end being secured to the front disk.

13. Apparatus according to claim 11, wherein the rolling element is a ball-type turntable fitted between the supporting ring and the bearing ring.

14. Apparatus according to claim 1, wherein the drum has drivers which project into the interior of the treatment chamber, the drivers including a plurality of blades and a plurality of pins, the blades and the pins being alternatively arranged in the circumferential direction.

15. Apparatus according to claim 14, wherein each of the two connecting lines of one of the ring-pocket sections bears directly against another one of the connecting lines of another one of the ring-pocket sections which is adjoining the one ring-pocket section in circumferential direction of the drum so that corresponding two connecting lines of different ring-pocket sections form a double channel but are separated from each other.

16. Apparatus according to claim 15, wherein the respective substantially radial separating members extend approximately as extensions of the separating line of the double channels.

17. Apparatus for tanning, dyeing and like treatment, comprising:

(a) a horizontal rotary drum having an axial front end and a circumferential surface;

(b) a treatment chamber defined in the rotary drum;

(c) a hollow axle which is in communication with the treatment chamber for carrying the drum and for the admission and drainage of liquid treatment media, said hollow axle having an interior defining a plurality of axially extending channels;

(d) at least two cylinder jacket chambers provided along the circumferential surface of the drum, each of the two jacket chambers being in communication with the treatment chamber, said jacket chambers being arranged at equal circumferential-angle intervals for defining two ring pocket sections extending axially over the length of the rotary drum and, in a top view, have approximately the shape of a trapezium; and (e) connecting lines communicating with the individual ring pocket sections and being provided only at the axial front end of the rotary drum for admission and drainage of the liquid treatment media so that the interior of the treatment chamber and the other axial front end of the rotary drum are free of connecting lines, each of said lines extending substantially radially between the drum center of the axial front end and the associated ring pocket section, and having one end opening into the interior of the associated ring pocket section and another end which is arranged in the region of the drum center opening into the respectively associated axial channels in the interior of the hollow axle, wherein the larger trapezium side of the trapezium points to the axial front end at which all the connecting lines are provided.

18. Apparatus according to claim 17, wherein the cylinder jacket chambers are formed by internal jacket segments which, in a top view, have the shape of a trapezium and are bent in two internal cylinder jacket parts which extend at least substantially concentrically to the circumferential surface of the drum.

19. Apparatus according to claim 17, wherein the cylinder jacket part has inclined edges which are chamfered and, with their free edges, are secured to the inside of the circumferential surface of the drum.

20. Apparatus according to claim 19, wherein the chamfered inclined edges seal the cylinder jacket chambers on both sides in the circumferential direction and extend, with respect to an axially parallel generating line, obliquely from one end towards the other end.

21. Apparatus according to claim 19, wherein the free edges are welded to the inside of the drum jacket.

22. Apparatus according to claim 17 wherein each of the cylinder jackets is in communication with two connecting lines arranged at the larger trapezium side of the cylinder jacket chambers one of the two connecting lines of each cylinder jacket chambers being provided at one circumferential end and the other connecting line being provided at the other circumferential end, closely adjacent to the respective inclined edges, wherein both connecting lines open with their respective ends into the cylinder jacket chambers.

23. Apparatus according to claim 17, wherein cylindrical jacket parts are formed from a substantially strip-shaped metal-sheet blank, with pieces which are directly consecutive in the strip direction and having trapezium positions which are oppositely directed relative to one another.

24. Apparatus according to claim 17, wherein the cylindrical jacket part has a shorter trapezium end and is provided with a plurality of ports along the axial length of the cylindrical jacket in such a manner that the width of the plurality of ports corresponds approximately to the shorter trapezium end.

25. Apparatus according to claim 24, wherein the cylinder jacket part is provided with perforated holes.

26. An apparatus for tanning, dyeing and like treatment, comprising (a) a horizontal rotary drum having an axial front end and a circumferential surface, the axial front end of the drum being formed as a front cover having a center provided with a port;

(b) a treatment chamber defined in the rotary drum;

(c) a hollow axle which is in communication with the treatment chamber for carrying the drum and for admission and drainage of liquid treatment media, said hollow axle having an interior which defines a plurality of axially extending channels, (d) at least two ring pocket sections provided along the circumferential surface of the drum, each of the two ring pocket sections being in communication with the treatment chamber;

(e) connecting lines communicating with the individual ring pocket sections and being provided only at the axial front end of the rotary drum for admission and drainage of the liquid treatment media so that the interior of the treatment chamber and the other axial front end of the rotary drum are free of connecting lines, each of said connecting lines extending substantially radially between the drum center of the axial front end and the associated ring pocket section, and having one end opening into the interior of the associated ring pocket section and another end which is arranged in the region of the drum center of the axial front end opening into the respectively associated axial channels in the interior of the hollow axle, wherein the other end of each connecting line leads separated from each other to the port provided in the center of the front cover into the associated axial channel in the hollow axle;

(f) a frame to which the rotary drum is mounted only at the axial front end carrying all the connecting lines, wherein the frame includes a stationary supporting ring which is coaxial to the rotary drum, a bearing ring coaxial with the supporting ring and fixedly connected to the front cover of the rotary drum and engaging over the supporting ring, and rolling elements provided between the supporting ring and the bearing ring; and (g) a drive for the rotary drum, the bearing ring being provided on its external circumferential surface with a toothing which cooperates with the rotary drum drive.

27. Apparatus according to claim 26, wherein the drive includes a geared motor and a drive pinion driven by the geared motor, the drive pinion meshing with the toothing.

* * * * *